United States Patent [19]

Sahm

[11] Patent Number: 4,736,528

[45] Date of Patent: Apr. 12, 1988

[54] HAIR DRYING APPARATUS

[76] Inventor: Jürgen E. Sahm, Baumgarten 21, 8905 Arni, Switzerland

[21] Appl. No.: 942,168

[22] Filed: Dec. 16, 1986

[30] Foreign Application Priority Data

Dec. 17, 1985 [CH] Switzerland ..... 5396/85

[51] Int. Cl.[4] ..... A45D 4/10

[52] U.S. Cl. ..... 34/98; 34/101

[58] Field of Search ..... 34/97, 98, 99, 101

[56] References Cited

U.S. PATENT DOCUMENTS

| | | | |
|---|---|---|---|
| 1,852,933 | 4/1932 | Maier | 34/98 |
| 2,059,329 | 11/1936 | Fisher . | |
| 2,645,034 | 7/1953 | Hupp . | |
| 2,897,603 | 8/1959 | Behrman | 34/99 |
| 3,444,624 | 5/1969 | Greenlee | 34/98 |
| 3,524,266 | 8/1970 | Hanisco | 34/99 |

FOREIGN PATENT DOCUMENTS

| | | | |
|---|---|---|---|
| 2058788 | 3/1972 | Fed. Rep. of Germany . | |
| 2349648 | 4/1975 | Fed. Rep. of Germany . | |
| 2747595 | 4/1979 | Fed. Rep. of Germany . | |
| 1326470 | 4/1963 | France . | |
| 1492342 | 7/1967 | France . | |
| 2068033 | 8/1971 | France . | |
| 2320503 | 3/1977 | France | 34/98 |
| 194999 | 3/1938 | Switzerland . | |
| 2082058 | 3/1982 | United Kingdom . | |

*Primary Examiner*—Larry I. Schwartz

*Attorney, Agent, or Firm*—Gordon W. Hueschen

[57] ABSTRACT

There is described a hair drying apparatus wherein the air feeding hoses are mounted to a respective connector member. Every connector member is coupled via a quick release device to the warm air distributing head. The user of the hair drying apparatus can leave temporarily the hair drying apparatus by simply detaching the connector members from the distributing head. The curlers and the warm air feeding hoses remain thus connected to the hair of the user.

4 Claims, 1 Drawing Sheet

HAIR DRYING APPARATUS

BACKGROUND OF THE INVENTION

1. Field of the Invention

The present invention relates to a hair drying apparatus including a means for blowing warm air coupled via a tubular member to a distributing head, and including warm air feeding hoses mounted group-wise via connector members to said distributing head, which said warm air feeding hoses are intended to be coupled to hair curlers intended for setting hair.

2. Description of the Prior Art

Generally known hair drying apparatuses of the kind mentioned above incorporate the drawback that the user is bound to a given apparatus until his hair has completely been dried and cannot leave the apparatus conveniently because he is coupled to such apparatus via his own hair.

SUMMARY OF THE INVENTION

Hence, it is a general object of the present invention to provide an improved construction of a hair drying apparatus which the user can easily leave for any reason and to reattach himself to the apparatus for finalizing the drying of his hair.

A further object of the invention is to provide a hair drying apparatus comprising connector members which are coupled to the distributing head by a quick release and closing device.

BRIEF DESCRIPTION OF THE DRAWING

The invention will be better understood and objects other than that set forth above will become apparent when consideration is given to the following detailed description thereof. Such description makes reference to the annexed drawing, wherein.

DESCRIPTION OF THE PREFERRED EMBODIMENTS

Figures 1, 2, 3, 4, 5, 6, 7:
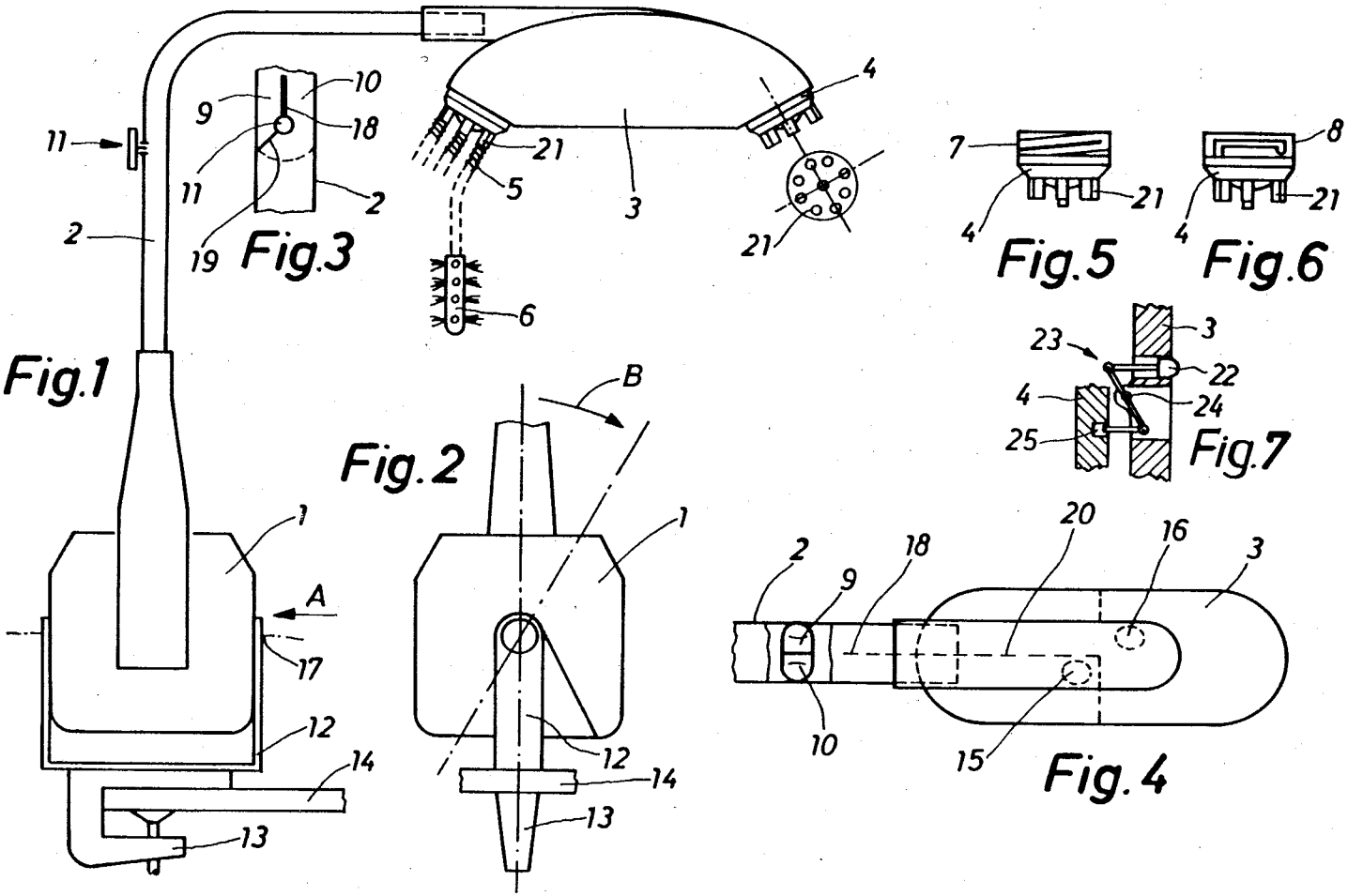
FIG. 1 illustrates a side view of a hair drying apparatus.
FIG. 2 illustrates a view of a part of the apparatus illustrated in FIG. 1 in direction of the arrow A of FIG. 1.
FIG. 3 illustrates schematically an arrangement of a change-over switch valve.
FIG. 4 is a top view of a distributing head.
FIG. 5 is a view of a first design of a connector member.
FIG. 6 is a second design of a connector member.
FIG. 7 is a third design of a connector member.

The warm air blower 1 illustrated in FIG. 1 is provided such as is generally known with an electro-motor, a blower and electrically excited air heating members. The warm air blower 1 is supported in a bracket 12 such to pivot around an axis 17. This bracket is seated on a screw clamp 13, by means of which the hair drying apparatus may be e.g. mounted to a table board 14.

A tubular member 2 extends from the warm air blowing device 1 to a distributing head 3. In the embodiment illustrated in FIG. 1 this tubular member 2 features a vertically extending section which extends via an elbow to a horizontally extending section. The connection between the tubular member 2 and the warm air blower 1 at the one side and the distributing head 3 at the other side is a simple plug connection. FIG. 4 illustrates specifically that the tubular member 2 has not a circular cross-sectional shape, it rather has an elongated cross-sectional shape. The inner space of the tubular member 2 is partitioned by a partition 18 into two longitudinally extending channels 9 and 10. A change-over switch valve 11 is mounted at the tubular member 2 such as illustrated in FIG. 1. This change-over switch valve 11 can be operated from the outside by means of a manually operated wheel or a corresponding control member. FIG. 3 illustrates specifically the flap 19 of the change-over switch valve allowing a choosing of one of the two longitudinal channels 9 and 10 regarding the feeding of warm air. In the illustrated switching position the warm air supply to the longitudinal channel 9 is blocked and warm air can be fed only into the longitudinal channel 10. In an intermediate position the channel choosing flap 19 is aligned with the partition wall 18 separating the two channels 9, 10 such that warm air is fed into both longitudinal channels 9, 10 and in a further position not illustrated the longitudinal channel 10 is blocked and warm air may be fed only into the longitudinal channel 9. This change-over switch valve 11 is provided with an arresting arrangement of generally known design, by means of which the change-over switch valve 11 can be arrested in any of the above described positions.

FIG. 2 illustrates how the warm air blower 1 can be pivoted around the axis 17 from a vertically upright position in the direction of the arrow B into an oblique position.

The somewhat flattened tubular member 2 is plugged at the end of its horizontally extending section into a distributing head 3. A partition 20 is located within this distributing head 3, which partition 20 is aligned with the partition 18 of the tubular member 2. Accordingly, the inner space of the distributing head 3 is divided into two chambers, of which one is connected warm air flow-wise via a through hole 15 to the longitudinal channel 10 and the other via a through hole 16 with the longitudinal channel 9. Accordingly, depending on a given switching position of the change-over switch valve either the left-hand connector member 4 or the right-hand connector member 4 illustrated in FIG. 1 or then both connector members 4 can be provided with warm air feed.

Each connector member 4 includes a plurality of stubs 21 which are plugged into the air feeding hoses 5, which air feeding hoses 5 in turn are coupled to the hair curlers 6 of generally known design. In the illustrated embodiment two connector members 4 are provided such that one can refer to two groups of air feeding hoses 5, whereby each group is mounted to a respective connector member 4.

Every connector member 4 is mounted or coupled, respectively, to the distributing head 3 in such a manner that it can be detached therefrom by a simple manual operation.

There are a plurality of possibilities to couple the connector members 4 speedily and easily releasable to the distributing head 3. The embodiment illustrated in FIG. 5 incorporates a screw thread 7 such that the connector member 4 can be removed after e.g. a quarter rotation thereof. The embodiment illustrated in FIG. 6 incorporates a bayonet-type fitting 8, of which the groove is located in the connector member 4 and the not specifically shown peg is located in the distributing head 3. A further embodiment is illustrated in FIG. 7. This embodiment incorporates a push button 22 acting onto a pivoting arm set 23 which pivots around a pivot pin 24 located in the distributing head 3. The distal end of the pivoting arm arrangement engages a recess 25 located in the connector member 4. A not specifically shown spiral spring surrounding e.g. the pivot pin 24 biases this push button locking member into the locking position. If now the user wishes to temporarily leave the hair drying apparatus for any reason, he must merely detach the connector members 4 from the distributing head 3 (obviously after switching off the warm air flow to that connector member or by switching off the electro-motor of the warm air blower) and accordingly, is no longer literally bound to his hair drying apparatus. Such occasion can arise e.g. if a telephone call has to be answered.

Accordingly, the user has a freedom of action during the hair drying and hair setting, which freedom has not been hitherto possible when utilizing known apparatuses. Furthermore, because the user can freely choose which group of air feeding hoses 5 shall be supplied with warm air, this apparatus allows a broader range of applications.

In the present specification and claims, the term "warm" is intended to define the temperatures to be in a range of about 42° C.–45° C. These low air temperatures are combined with a high air volume resulting in a relatively short drying time such that the health and shininess of the hair is not impaired.

While there are shown and described present preferred embodiments of the invention, it is to be distinctly understood that the invention is not limited thereto, but may be otherwise variously embodied and practiced within the scope of the following claims.

I claim:

1. A hair drying apparatus including a means for blowing warm air coupled via a multiple channeled tubular member into a compartmented distributing head, each channel of said tubular member communicating with a compartment of said distributing head, and including warm air feeding hoses mounted groupwise via connector members to the several compartments of said distributing head, which said warm air feeding hoses are intended to be coupled to hair curlers intended for setting hair, and means for switching off air flow to a selected compartment so that a connector member connected thereto can be removed, in which said connector members are coupled to said distributing head by a quick release device.

2. The hair drying apparatus of claim 1, wherein said tubular member is divided into parallel longitudinal channels equalling the number of said compartments, and wherein said tubular member includes a change-over switch valve operative to interrupt a streaming of warm air to at least one of said longitudinal channels.

3. The hair drying apparatus of claim 1, in which said multiple channeled tubular member is non-flexible and is pivotably supported on a bracket, which bracket includes a mounting member intended for a mounting thereof to a rigid furniture member and means for limiting the pivot to an acute angle.

4. The hair drying apparatus of claim 1, in which the channeled tubular member comprises a flattened, non-flexible tube having a dividing partition extending diametrically across from one flattened side to the other flattened side throughout the length of the tube, thereby forming two warm air-conducting channels and, the distributing head has two compartments, and which further comprises means for directing warm air flow from one channel into one compartment and means for directing warm air flow from the other channel into the other compartment, said means for switching off the air flow comprising a means for blocking warm air flow into a selected channel.

* * * * *

UNITED STATES PATENT AND TRADEMARK OFFICE

CERTIFICATE OF CORRECTION

PATENT NO. : 4,736,528

DATED : April 12, 1988

INVENTOR(S) : Jürgen E. Sahm

It is certified that error appears in the above-identified patent and that said Letters Patent is hereby corrected as shown below:

Title Page, [56] References Cited, FOREIGN PATENT DOCUMENTS;
line 1, second column "3/1972" should read -- 5/1972 --
line 5, first column "1492342" should read -- 1492347 --
line 7, second column "3/1977" should read -- 4/1977 --

Col. 4, line 13; after "parallel" insert a comma -- , --

Signed and Sealed this

Eighteenth Day of October, 1988

*Attest:*

*Attesting Officer*

DONALD J. QUIGG

*Commissioner of Patents and Trademarks*